US011615950B2

(12) United States Patent
Murray et al.

(10) Patent No.: US 11,615,950 B2
(45) Date of Patent: Mar. 28, 2023

(54) MALDI NOZZLE

(71) Applicant: Micromass UK Limited, Wilmslow (GB)

(72) Inventors: Paul Murray, Wilmsow (GB); Mark Towers, Wilmsow (GB); Matthew Henderson, Wilmsow (GB); Andrew Whatley, Wilmsow (GB)

(73) Assignee: Micromass UK Limited, Wilmslow (GB)

( * ) Notice: Subject to any disclaimer, the term of this patent is extended or adjusted under 35 U.S.C. 154(b) by 57 days.

(21) Appl. No.: 17/280,421

(22) PCT Filed: Sep. 26, 2019

(86) PCT No.: PCT/GB2019/052706
§ 371 (c)(1),
(2) Date: Mar. 26, 2021

(87) PCT Pub. No.: WO2020/065312
PCT Pub. Date: Apr. 2, 2020

(65) Prior Publication Data

US 2022/0005684 A1 Jan. 6, 2022

(30) Foreign Application Priority Data

Sep. 26, 2018 (GB) ..... 1815676

(51) Int. Cl.
*H01J 49/16* (2006.01)
*H01J 49/04* (2006.01)
*H01J 49/26* (2006.01)

(52) U.S. Cl.
CPC ..... *H01J 49/164* (2013.01); *H01J 49/0418* (2013.01); *H01J 49/0481* (2013.01); *H01J 49/26* (2013.01)

(58) Field of Classification Search
CPC .. H01J 49/164; H01J 49/0418; H01J 49/0481; H01J 49/26
See application file for complete search history.

(56) References Cited

U.S. PATENT DOCUMENTS

2003/0098413 A1 5/2003 Weinberger et al.
2003/0178562 A1 9/2003 Makarov et al.
(Continued)

FOREIGN PATENT DOCUMENTS

EP 2405463 A1 1/2012
WO 2003081205 A2 10/2003
WO 2013098610 A1 7/2013

OTHER PUBLICATIONS

Combined Search and Examination Report for GB1815676.0, dated Mar. 27, 2019.

(Continued)

*Primary Examiner* — Nicole M Ippolito
*Assistant Examiner* — Hanway Chang
(74) *Attorney, Agent, or Firm* — Goodwin Procter LLP

(57) ABSTRACT

A nozzle for an ionisation source comprises: a light passage having an inlet end and an outlet end; and a gas flow passage in fluid communication with the light passage, wherein the gas flow passage is configured to convey, in use, a flow of gas into the light passage such that the flow of gas travels substantially towards the outlet end of the light passage.

20 Claims, 6 Drawing Sheets

(56) References Cited

U.S. PATENT DOCUMENTS

| | | | | |
|---|---|---|---|---|
| 2005/0056776 | A1* | 3/2005 | Willoughby ..... | H01J 49/164<br>250/288 |
| 2010/0032559 | A1 | 2/2010 | Lopez-Avila et al. | |
| 2015/0008313 | A1 | 1/2015 | Loboda | |

OTHER PUBLICATIONS

International Search Report and Written Opinion for International Application PCT/GB/2019/052706, dated Dec. 3, 2019.

* cited by examiner

MALDI NOZZLE

CROSS-REFERENCE TO RELATED APPLICATIONS

This application is a U.S. national phase filing claiming the benefit of and priority to International Patent Application No. PCT/GB2019/052706, filed Sep. 26, 2019, which claims priority from and the benefit of United Kingdom patent application No. 1815676.0 filed on Sep. 26, 2018. The entire contents of these applications are incorporated herein by reference.

FIELD OF INVENTION

Embodiments described herein relate generally to ionisation sources and in particular to a nozzle for a Matrix Assisted Laser Desorption Ionisation ("MALDI") ion source.

BACKGROUND

Mass spectrometers comprising a Matrix Assisted Laser Desorption Ionisation ("MALDI") ion source are known. MALDI mass spectrometry is a known process which is particularly suited for the analysis of non-volatile mass spectrometry. A suitable matrix material (e.g. an organic solvent) is added to a sample so that the sample becomes embedded in the matrix material. The embedded sample is then positioned on a metal plate and a laser pulse is directed on to the target sample. The laser pulse impinging upon the target sample causes analyte material to be ablated and desorbed from the target sample. Analyte ions are generated by analyte material being protonated and deprotonated in a hot plume of gaseous molecules which is released from the target. The matrix has a strong absorption at the wavelength of the laser pulse and acts as a proton source to encourage ionisation of the analyte. The gaseous plume which is released from the target comprises a mixture of analyte ions together with uncharged material. The mixture of analyte ions and uncharged material is then directed towards the inlet of a mass spectrometer. The ions are directed towards the mass spectrometer by an ion guide using electric fields. The analyte ions are separated from the uncharged material with the analyte ions being onwardly transmitted to a mass analyser of the mass spectrometer in order to be mass analysed.

Although the analyte ions are directed towards the mass spectrometer, the uncharged material may instead disperse into the vacuum chamber. As a result, the matrix may adsorb onto the surrounding surfaces in the vacuum chamber, resulting in a gradual build-up of material.

Any laser optics within the vacuum chamber can be susceptible to this matrix depositing on their surfaces, particularly if they are in a direct line of sight of the ablation. This can cause the transmissivity of the mirror to be reduced ("fogging"), while any material deposited on the optic surface may absorb subsequent laser radiation, causing localized heating at the point that the laser impinges on the surface, resulting in damage to the optic surface. This, in turn, may make the optic surface more absorbing, causing further damage.

Current approaches rely on either creating sufficient distance between the sample and the laser optics to prevent the uncharged material from reaching the laser optics and/or providing a flow of gas across the optic path ("gas curtain") in an attempt to block the uncharged material from reaching the laser optics. However, this is not always effective and can result in a loss of spatial resolution when the optics are arranged far away from the sample.

Embodiments described herein seek to alleviate or reduce the amount of contaminants reaching the laser optics. Embodiments described herein also seek to alleviate of reduce the amount of damage caused to laser optics during MALDI mass spectrometry. Embodiments described herein also combine the delivery of a cooling gas, with a method of generating a gas shield, to protect the laser optics by reducing the amount of ablated material adsorbed on the optics.

SUMMARY OF THE INVENTION

One aspect of the present invention provides a nozzle for an ionisation source comprising:

a light passage having an inlet end and an outlet end; and a gas flow passage in fluid communication with the light passage, wherein the gas flow passage is configured to convey, in use, a flow of gas into the light passage such that the flow of gas travels substantially towards the outlet end of the light passage.

In at least one embodiment, the gas flow passage is in fluid communication with the light flow passage between the inlet end of the light passage and the outlet end of the light passage.

In at least one embodiment, the nozzle further comprises a window disposed along the light passage.

In at least one embodiment, the window is disposed adjacent the inlet end of the light passage.

In at least one embodiment, the window is received in a recess adjacent the inlet end of the light passage.

In at least one embodiment, the cross-sectional area of the inlet end of the light passage is larger than the cross-sectional area of the outlet end of the light passage.

In at least one embodiment, the light passage is substantially conical.

In at least one embodiment, the nozzle further comprises an aperture configured to receive an ion guide.

In at least one embodiment, the angle between the longitudinal axis of the light passage and the longitudinal axis of the aperture is between 0 and 90 degrees, or between 0 and 45 degrees, or between 0 and 30 degrees.

In at least one embodiment, the nozzle further comprises a viewing passage, wherein the angle between the longitudinal axis of the viewing passage and the longitudinal axis of the aperture is different to the angle between the longitudinal axis of the light passage and the longitudinal axis of the aperture.

In at least one embodiment, the nozzle further comprises a guard which extends in a direction of the longitudinal axis of the aperture.

Another aspect of the present invention provides a nozzle assembly comprising:

the nozzle of this disclosure;

an ion guide; and an extraction electrode.

In at least one embodiment, the ion guide is a hexapole ion guide.

In at least one embodiment, the extraction electrode is disposed adjacent the outlet end of the light passage.

In at least one embodiment, the extraction electrode comprises a sample inlet configured to receive at least some of an ionised sample in use.

Another aspect of the present invention provides an ionisation assembly comprising:

an ionisation chamber; and the nozzle assembly of this disclosure received in the ionisation chamber.

In at least one embodiment, the nozzle assembly is slidably receivable in the ionisation chamber.

In at least one embodiment, the ionisation chamber is a vacuum chamber.

In at least one embodiment, the ionisation assembly further comprises a gas supply passage having an inlet end outside of the ionisation chamber to receive a flow of gas, and an outlet end, wherein the gas flow passage of the nozzle has an inlet end which is fluidly connected to the outlet end of the gas supply passage when the nozzle is received in the ionisation chamber.

In at least one embodiment, the ionisation assembly further comprises a beam steering arrangement configured to direct a light source through the light passage in use.

In at least one embodiment, the beam steering arrangement comprises at least one mirror disposed inside the ionisation chamber.

In at least one embodiment, the ionisation assembly further comprises a laser light source.

Another aspect of the present invention provides a nozzle for an ionisation source comprising:

a light passage having an inlet end and an outlet end; and a window disposed at a location along the light passage.

Another aspect of the present invention provides a nozzle for an ionisation source comprising:

a light passage having an inlet end and an outlet end.

DETAILED DESCRIPTION OF THE INVENTION

Figure 1:
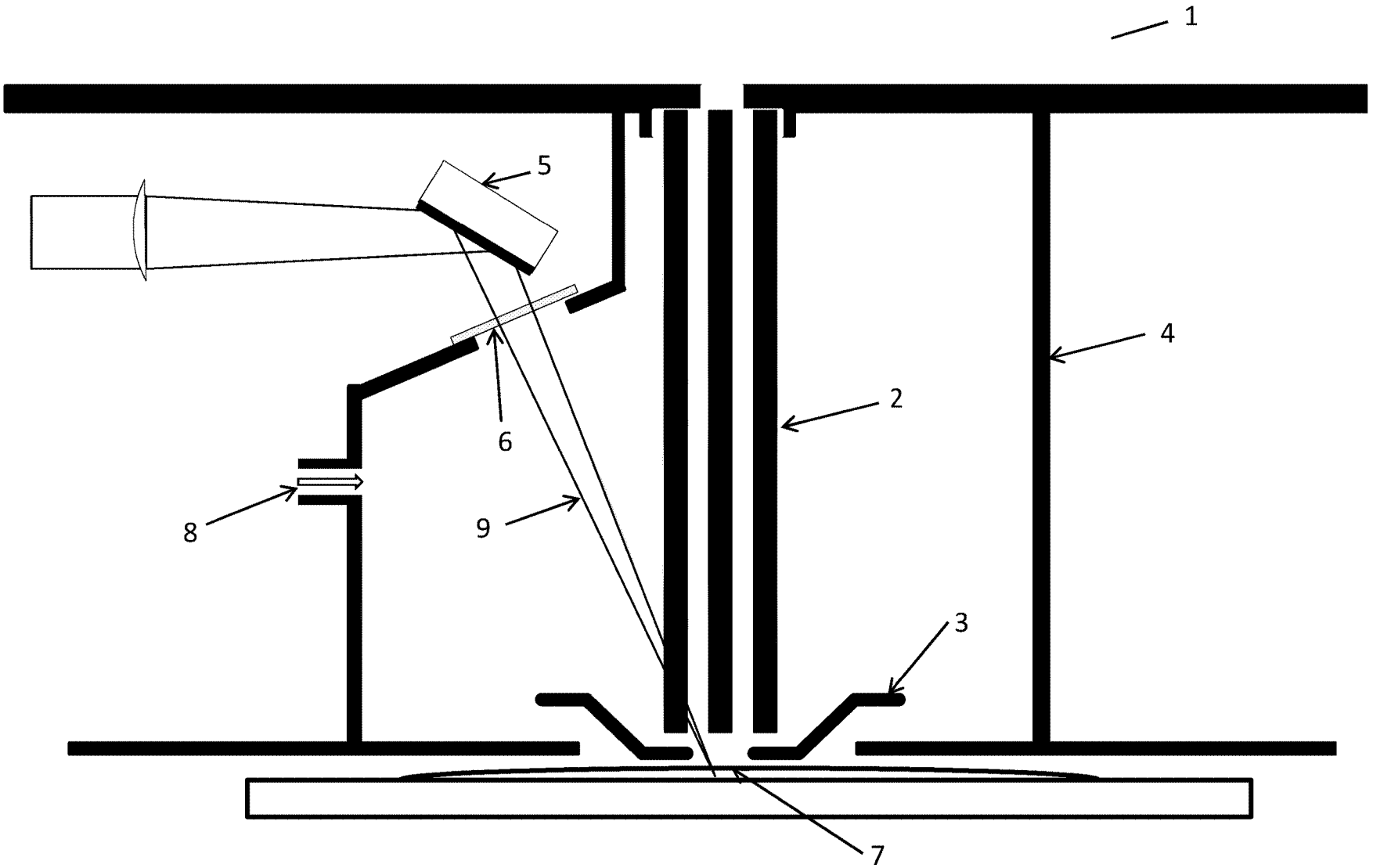
FIG. 1 illustrates a known MALDI ion source.

FIG. 1 illustrates a known MALDI ion source 1. An ion guide 2 and an extraction electrode 3 are received in an ionisation chamber 4. A beam steering arrangement 5 is disposed outside of the ionisation chamber 4. A window 6 is provided in the side of the ionisation chamber 4 to allow a light beam 9 to travel through the ionisation chamber 4 towards a sample for ionisation. In use, the light beam will interact with the beam steering arrangement 5 and pass through the window 6 to impinge on a sample surface 7. A resulting plume of ablated material may expand and dissipate from the sample within the ionisation chamber 4. The majority of ions formed may be captured by the ion guide 2 and transferred into the front of a mass spectrometer. A collisional cooling gas is introduced through the gas port 8 in the ionisation chamber 4 to raise the pressure in the ionisation chamber 4. The majority of the uncharged ablated material is slowed by the surrounding collisional gas, and is deposited on the front of the extraction electrode 3. As the ions traverse the ion guide 2, the ion beam is condensed by the collisional cooling gas. The gas is delivered across the path between the sample surface 7 and the laser window 6 with the intent of providing a gas 'curtain', to help prevent material depositing on the window 6.

Figure 2:
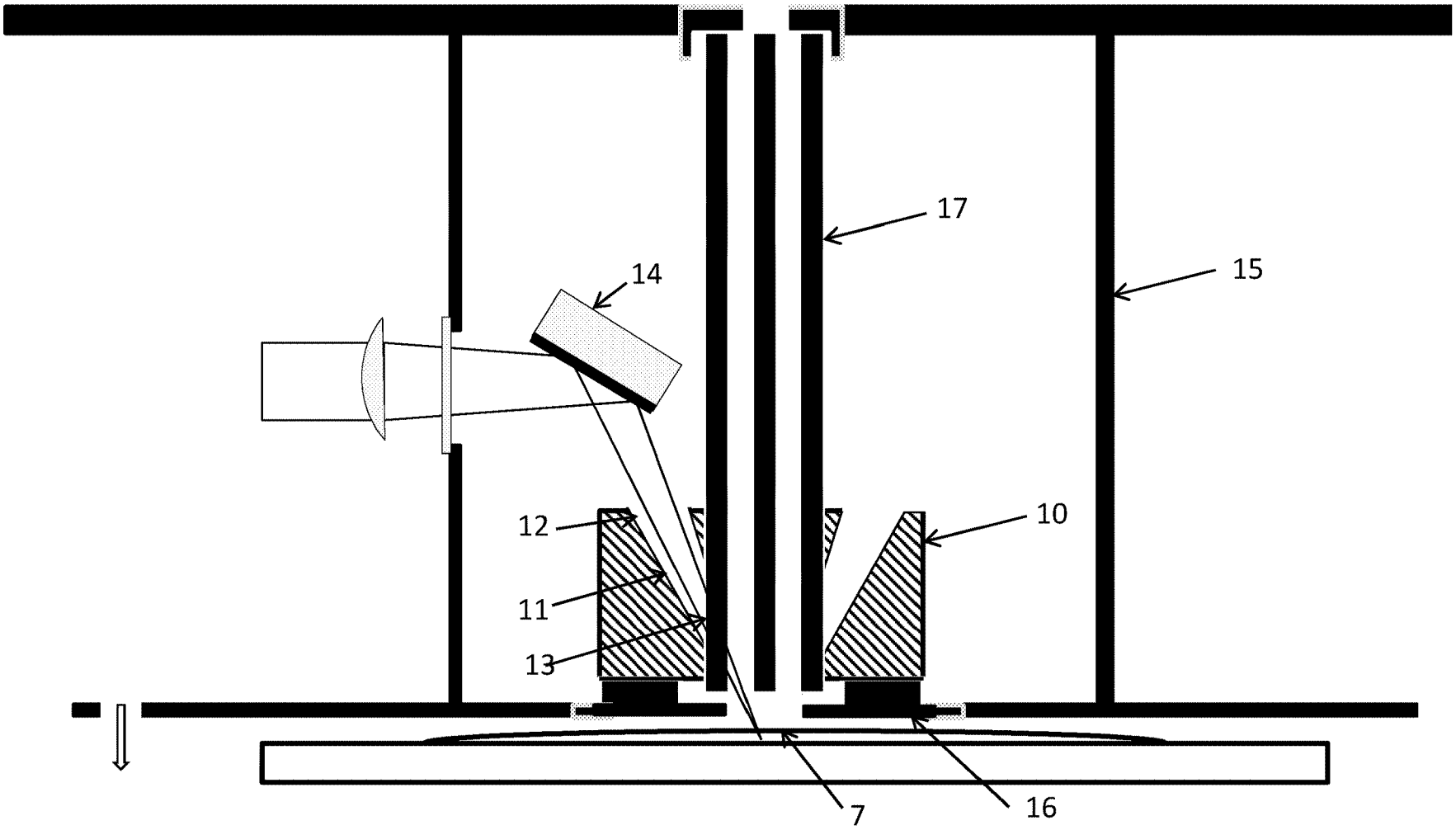
FIG. 2 illustrates a nozzle according to one embodiment of the present invention, shown in cross-section.

FIG. 2 illustrates a nozzle 10 for an ionisation source according to one embodiment of the present invention. The nozzle 10 is shown in cross-section. The nozzle 10 comprises a light passage 11 which has an inlet end 12 and an outlet end 13. In FIG. 1, the beam steering arrangement 5 is provided outside of the ionisation chamber 4 in order to protect the beam steering arrangement 5. This causes the light beam to have a relatively long focal length, as well as a relatively high angle of incidence with the sample surface 7. This may lead to an overall reduction in special resolution. In the arrangement of FIG. 2, at least a part of the beam steering arrangement 14 is provided within the ionisation chamber 15. This allows the beam steering arrangement 14 to be much closer to the nozzle 10, resulting in the focal length of a light source being reduced. Alternatively or additionally, the beam steering arrangement 14 may be disposed closer to the ion guide, resulting in the angle of incidence of a light source being reduced.

In FIG. 2, a collisional cooling gas is introduced into the chamber 15 through the extraction electrode 16 in a direction along the ion guide 17. This may provide an increase in the efficiency of the system and may almost double the number of ions delivered through the ion guide 17, as the direction of flow of the gas helps drive the MALDI plume into the confining volume of the ion guide 17. However, the collisional cooling gas may also carry some of the uncharged ablated material through the light passage 11, towards the beam steering arrangement 14. This ablated material may then deposit on the beam steering arrangement 14, reducing the effectiveness of the arrangement and potentially causing damage, as with the arrangement of FIG. 1.

Figure 3:
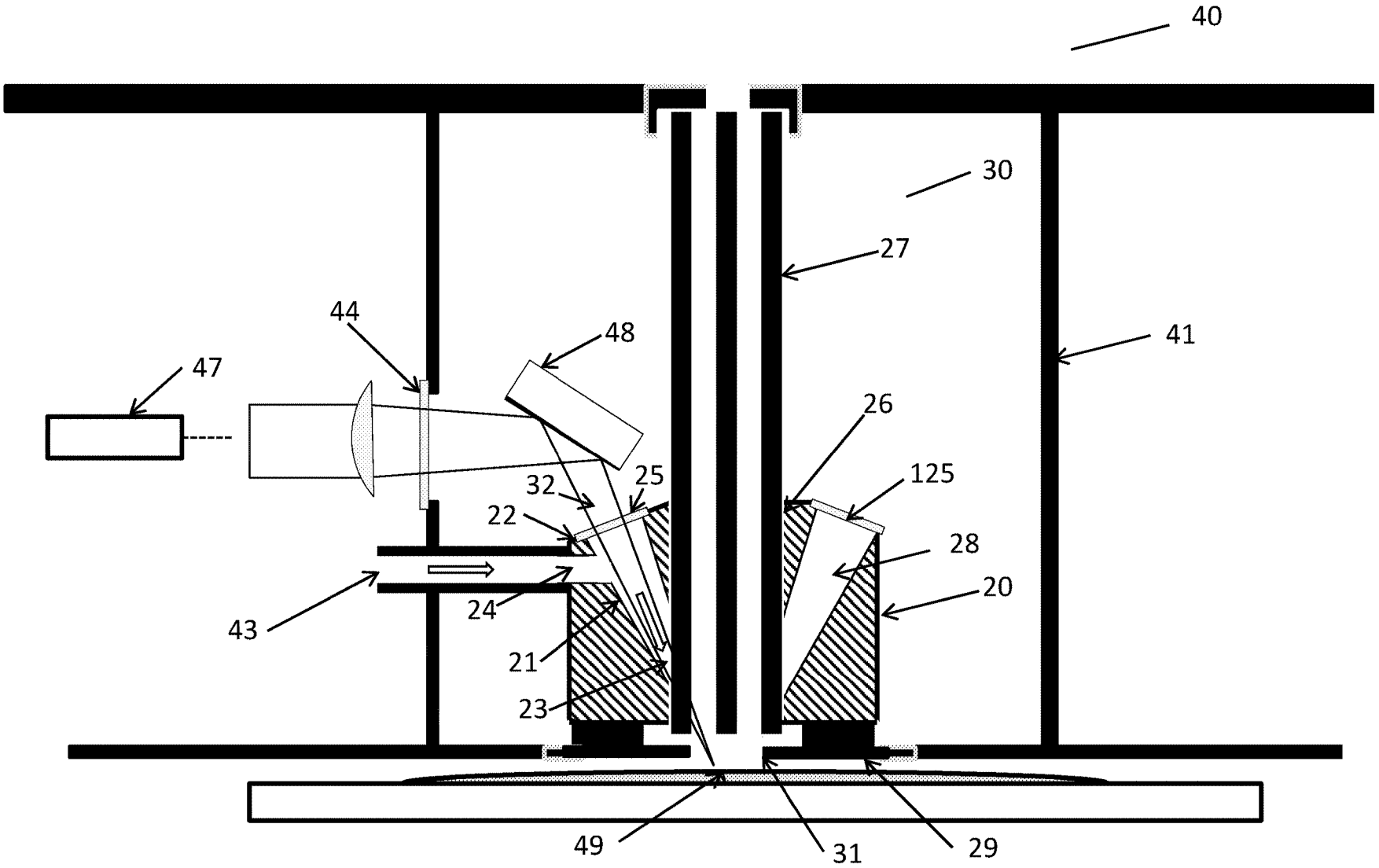
FIG. 3 illustrates an ionisation arrangement according to one embodiment of the present invention, incorporating a nozzle shown in cross-section.

FIG. 3 illustrates a nozzle 20 for an ionisation source according to one embodiment of the present invention. The nozzle 20 is shown in cross-section. The nozzle 20 comprises a light passage 21 and a gas flow passage 24. The light passage 21 has an inlet end 22 and outlet end 23. The gas flow passage 24 is in fluid communication with the light passage 21. The gas flow passage 24 is configured to convey, in use, a flow of gas into the light passage 21. The flow of gas travels substantially towards the outlet end 23 of the light passage 21. Although some of the gas may flow towards the inlet end 22 of the light passage 21, a suitable amount flows towards the outlet end 23 of the light flow passage 21. This flow of gas provides a barrier to oppose the flow of ablated material through the light passage 21. The light passage 21 is substantially straight, such that a light source can pass through the light passage 21.

At least an exit end of the gas flow passage 24 is angled with respect to the light passage 21. In at least one embodiment, the angle may be between 1 and 179 degrees. The gas flow passage 24 is not coaxial with the light passage 21. In at least one embodiment, the angle may be 90 degrees. In at least one embodiment, the angle may be between 45 and 89 degrees, such that there is an acute angle between the gas flow passage 24 and the inlet end 22 of the light passage 21. Angling the gas flow passage 24 with respect to the light passage 21, particularly by an acute angle, promotes the flow of gas towards the outlet end 23 of the light passage. If the gas flow passage 24 is angled with respect to the light passage 21 by an angle of substantially 90 degrees, there may be provided a baffle and/or other flow directing means, to promote the flow of gas towards the outlet end 23 of the light passage 21.

In one embodiment, the nozzle is made of an insulting material.

In the embodiment shown in FIG. 3, the gas flow passage 24 is in fluid communication with the light passage 21 between the inlet end 22 of the light passage 21 and the outlet end 23 of the light passage 21. Alternatively or additionally, the point of fluid communication between the light passage 21 and the gas flow passage may be at the midpoint between the inlet end 22 and the outlet end 23 of the light passage 21. In one embodiment, the point of fluid communication may be closer to the inlet end 22 of the light passage 21 than the outlet end 23 of the light passage 21, or vice versa.

In one embodiment, the gas provided through the gas flow passage 24 is a collisional cooling gas. Additionally or alternatively, the gas can be used as a carrier gas to transfer reagent molecules into the vicinity of the plume.

The nozzle 20 may also comprise a window 25 disposed along the light passage 21. The window 25 provides a physical barrier that may prevent material (e.g. a gas or ablated material) from exiting through the inlet end 22 of the light passage 21. The window 25 may also help to direct the flow of gas towards the outlet end 23 of the light passage 21 by providing a single flow path for the gas to travel along.

In one embodiment, the window 25 is disposed adjacent the inlet end 22 of the light passage 21. Alternatively or additionally, the window 25 may be received in a recess adjacent the inlet end 22 of the light passage 21. The recess also helps to secure the window 25 in place by constraining movement in at least one direction.

The window 25 may be integrally formed with the nozzle 20 or may be provided as a separate component. Alternatively or additionally, the window 25 may be removable and/or replaceable. This allows the window 25 to be individually removed from the nozzle to be cleaned or replaced, without having to clean or replace the whole nozzle 20.

The light passage 21 shown in FIG. 3 is substantially conical. In one embodiment, the cross-sectional area of the inlet end 22 of the light passage 21 is larger than the cross-sectional area of the outlet end 23 of the light passage 21. In one embodiment, the inlet end 22 of the light passage 21 may have a larger cross-sectional area than that of the light beam 32 at the inlet end 22 of the light passage 21. In one embodiment, the diameter of the inlet end 22 of the light passage 21 is about 2 mm. Alternatively or additionally, the diameter of the inlet end 22 of the light passage 21 may be between about 2 mm and 6 mm. In one embodiment, the diameter of the outlet end 23 of the light passage may be between about 0.5 mm and 6 mm. In one embodiment, the light passage 21 may be substantially cylindrical. In one embodiment, the diameter of the cylindrical light passage 21 may be about 2 mm. Alternatively or additionally, the diameter of the cylindrical light passage may be between about 2 mm and 6 mm. In one embodiment, the light passage 21 comprises a tube.

As shown in FIG. 3, the nozzle 20 may comprise an aperture 26 configured to receive an ion guide 27. The ion guide 27 may be securable to the nozzle 20 through a press fit/interference fit. Alternatively or additionally, the ion guide 27 may be securable to the nozzle 20 using any other suitable method. As shown in FIG. 3, the aperture 26 may extend through the nozzle 20. This allows an end of the ion guide 27 to be arranged closer to a sample location, so that the ionised particles travel a smaller distance to reach the ion guide 27. Additionally or alternatively, the aperture 26 may extend through a part of the nozzle 20. Additionally or alternatively, at least a part of the aperture 26 may have a smaller cross-sectional area than that of the ion guide 27. Alternatively or additionally, at least a part of the aperture 26 may have a larger cross-sectional area than that of the ion guide 27.

The angle between the longitudinal axis of the light passage 21 and the longitudinal axis of the aperture 26 (and thus the longitudinal axis of the ion guide) may be between 0 and 45 degrees. Alternatively, the angle may be between 0 and 30 degrees. It is advantageous to ensure that the angle between the longitudinal axis of the light passage 21 and the longitudinal axis of the aperture 26 is minimised and is as close to zero degrees as possible. This causes a light beam passing through the nozzle 20 to impinge on a sample surface with a less elliptical cross section. In one embodiment, the diameter of the light beam at the sample is about 15 μm. Alternatively, the diameter of the light beam at the sample may be between 5 μm and 20 μm.

The gas flow passage 24 may be substantially perpendicular to the longitudinal axis of the aperture 26 (and thus the longitudinal axis of the ion guide).

It is advantageous for a light beam 32 to impinge on a sample surface 49 along, or close to, the normal of the sample surface 49 (i.e. substantially perpendicular to the sample surface 49) to minimise ellipticity. In the arrangement of FIG. 3, the ion guide 27 is arranged substantially perpendicular to the sample surface 49. This prevents the beam steering mirror 48 from being positioned to direct the light beam 32 along, or near to, the normal of the sample surface 49. In one embodiment, the ion guide 27 may be arranged at an angle with respect to the sample surface 49. Advantageously, this may allow the light beam 32 to be directed along, or near to, the normal of the sample surface 49, as the ion guide 27 is no longer in the way. Alternatively or additionally, the sample surface 49 may be angled with respect to the ionisation chamber 41, to allow the light beam 32 to be directed along, or near to, the normal of the sample surface 49.

In one embodiment, the nozzle 20 further comprises a viewing passage 28. The viewing passage 28 may be used to visually verify that the arrangement is correctly aligned. The angle between the longitudinal axis of the viewing passage 28 and the longitudinal axis of the aperture 26 may be different to the angle between the longitudinal axis of the light passage 21 and the longitudinal axis of the aperture 26. This may prevent or reduce the amount of light that is reflected directly off of the sample into either the eye of an operator or a camera. The viewing passage 28 may be directly viewed by a user and/or may comprise a camera or other light sensing device to monitor the alignment.

Figure 4:
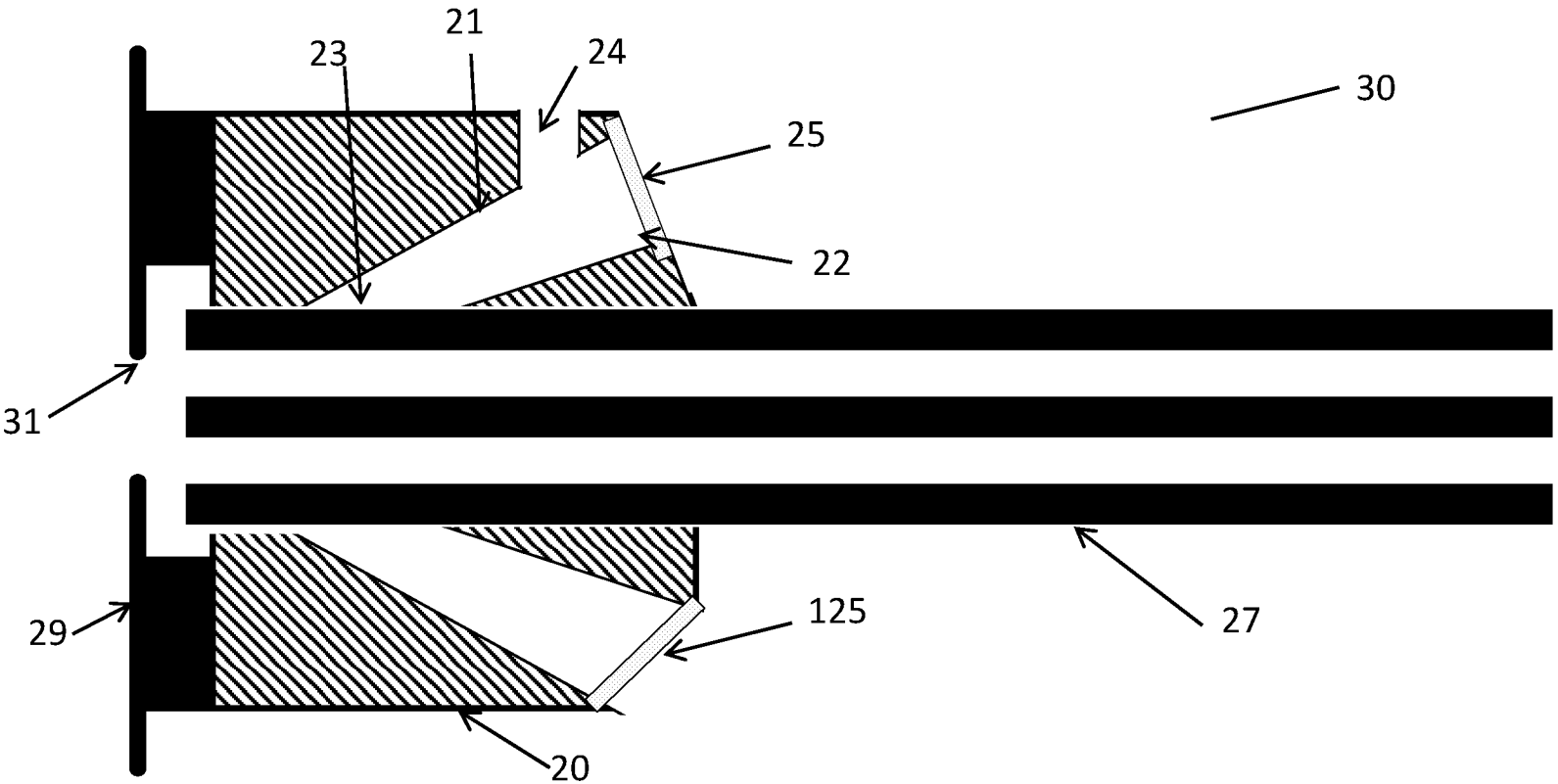
FIG. 4 illustrates a nozzle arrangement, shown in cross-section according to one embodiment of the present invention.

The embodiment shown in FIGS. 3 and 4 further comprises a viewing window 125 disposed at or near the end of the viewing passage 28 (the end remote from the aperture 31). The viewing window 125 may take the same or similar form as the window 25 disposed in the light passage 21. The viewing window 125 serves to enclose the volume of the nozzle 20 and may prevent material (e.g. a gas or ablated material) from exiting through the viewing passage 28. Any of the other embodiments disclosed herein may also be provided with a viewing window 125.

In one embodiment, the ionisation source is a Matrix Assisted Laser Desorption Ionisation source. Additionally or alternatively, the ionisation source may be any other suitable ionisation source.

In one embodiment, a nozzle assembly 30 is provided as shown in FIG. 4. Like components are given the same reference numerals as FIG. 3. The nozzle assembly 30 comprises a nozzle 20, an ion guide 27 and an extraction electrode 29. The extraction electrode 29 may be disposed adjacent the outlet end 23 of the light passage 21. Alternatively or additionally, the extraction electrode 29 comprises a sample aperture 31 configured to receive at least some of an ionised sample. In one embodiment the ion guide 27 is a hexapole ion guide. Additionally or alternatively, any other suitable configuration of ion guide may be use. Alternatively or additionally, the extraction electrode 29 may be securable to the nozzle 20. The extraction electrode 29 may be securable through an adhesive, press-fit, or any other suitable securing method. By securing the extraction electrode 29 to the nozzle 20, both components can be removed as a unitary item to be serviced. Furthermore, securing the components together may prevent relative movement between the components, which may result in misalignments.

As shown in FIG. 4, the nozzle assembly 30 may be provided in a single unit which can be removed from an ionisation assembly in order for it to be cleaned. It may be cleaned as a single unit or alternatively, it may be disassembled and cleaned separately. For example, a window 37 may be provided which can be individually removed for cleaning.

In one embodiment, an ionisation assembly 40 is provided, as shown in FIG. 3. The ionisation assembly 40 comprises an ionisation chamber 41 and a nozzle assembly 30 received in the ionisation chamber 41. In one embodiment, the nozzle assembly 30 is slidably received in the ionisation chamber 41. The nozzle assembly 30 may be slidably received through the use of rails provided in the ionisation chamber 41. The ionisation chamber 41 may be held at atmospheric pressure or may be held below atmospheric pressure. In one embodiment, the ionisation chamber 41 is a vacuum chamber.

In one embodiment, the ionisation assembly 40 comprises a gas supply passage 43. The gas supply passage 43 may have an inlet end 44 outside of the ionisation chamber 41 to receive a flow of gas. The gas supply passage 43 may also comprise an outlet end 45. The gas flow passage 24 of the nozzle 20 has an inlet end 46 which is fluidly connected to the outlet end 45 of the gas supply passage 43 when the nozzle 20 is received in the ionisation chamber 41. Alternatively or additionally, the gas supply passage 43 may comprise a flexible tube. Alternatively or additionally, the gas supply passage 43 may take any other suitable form provided it allows a gas to be delivered into the gas flow passage.

Although FIG. 3 shows a gas entering into the light flow passage 21, in one embodiment, a gas may also be introduced through the extraction electrode 29 (as in FIG. 2). In one embodiment, the extraction electrode 29 also forms a seal with the ionisation chamber 41.

In one embodiment, the ionisation assembly 40 comprises a light source 47. In one embodiment, the light source 47 is a laser light source.

In one embodiment, the ionisation assembly 40 comprises a beam steering arrangement 48. The beam steering arrangement 48 may be configured to direct a light source 47 through the light passage 22. The beam steering arrangement 48 may comprise at least one mirror. The at least one mirror may be disposed inside the ionisation chamber 41.

In one embodiment, the beam steering arrangement 48 additionally comprises at least one lens. The at least one lens may be configured to focus the light source. As discussed previously, it is advantageous to avoid using a long focal length. In one embodiment, the focal length of the light source is 75 mm.

Figure 5:
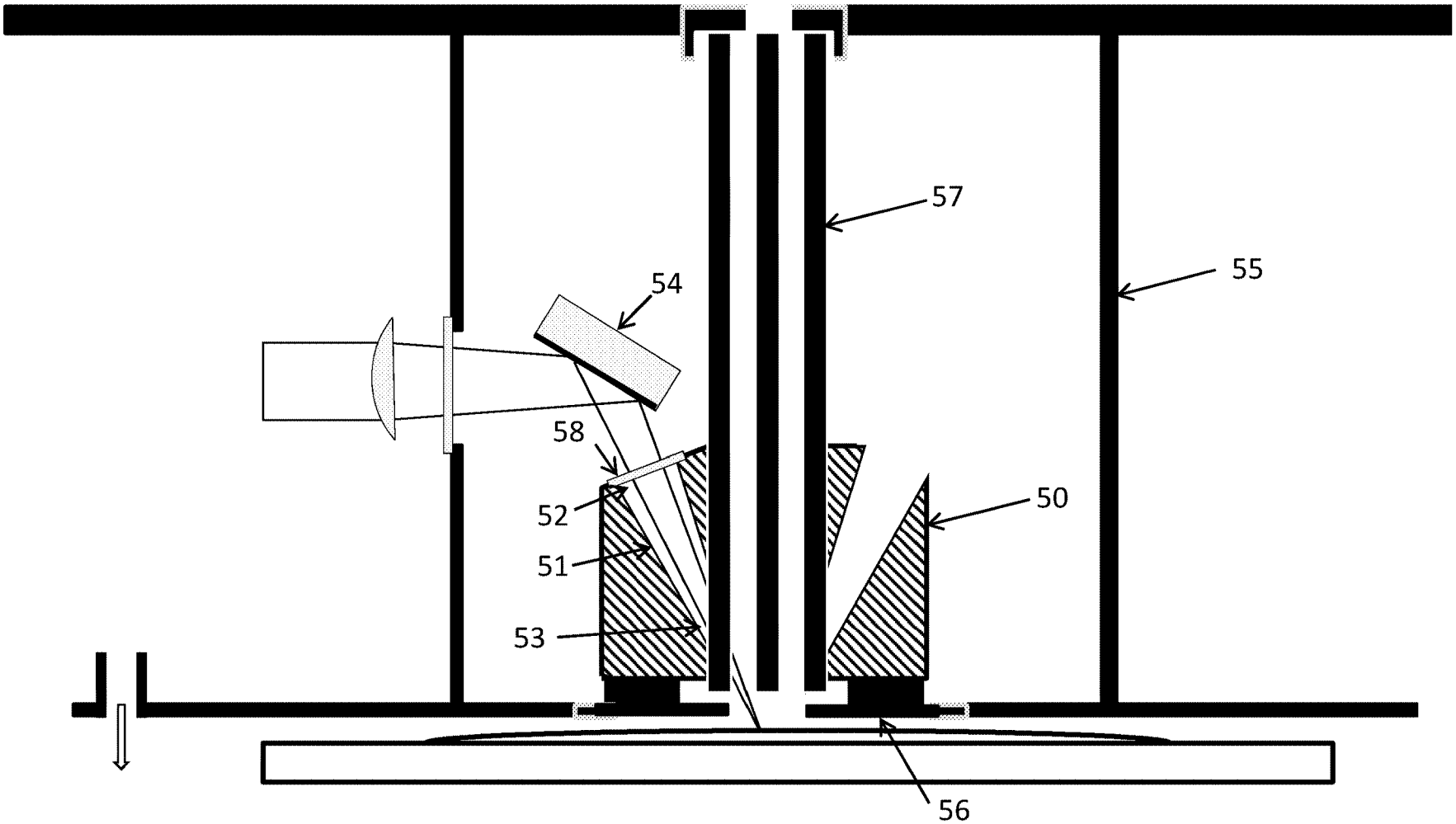
FIG. 5 illustrates an ionisation arrangement according to one embodiment of the present invention, incorporating a nozzle shown in cross-section.

FIG. 5 illustrates an alternative embodiment of a nozzle 50 for an ionisation source. Similar to FIG. 2, the nozzle 50 comprises a light passage 51 having an inlet end 52 and an outlet end 53. A beam steering arrangement 54 is provided within the ionisation chamber 55. A collisional cooling gas may be provided through an extraction electrode 56 and be directed along an ion guide 57. As previously discussed, this arrangement may increase the effectiveness of the system by increasing the number of ions delivered through the ion guide 57. However, it may also lead to damage of the beam steering arrangement 54. To help alleviate or overcome this problem, a window 58 is disposed along the light passage 51. In one embodiment the window 58 may be disposed adjacent the inlet end 52 of the light passage 51. Alternatively or additionally, the window 58 may be disposed in a recess adjacent the inlet end 52 of the light passage 51. As with the embodiment of FIG. 3, the window 58 provides a physical barrier that may prevent material (e.g. a gas or ablated material) from exiting through the inlet end 22 of the light passage 21.

An ion guide 27 used in any of the embodiments discussed herein may comprise a plurality of cylindrical poles arranged, in parallel, in a square, hexagonal or substantially circular pattern. There may be gaps between each of the poles.

Figure 6:
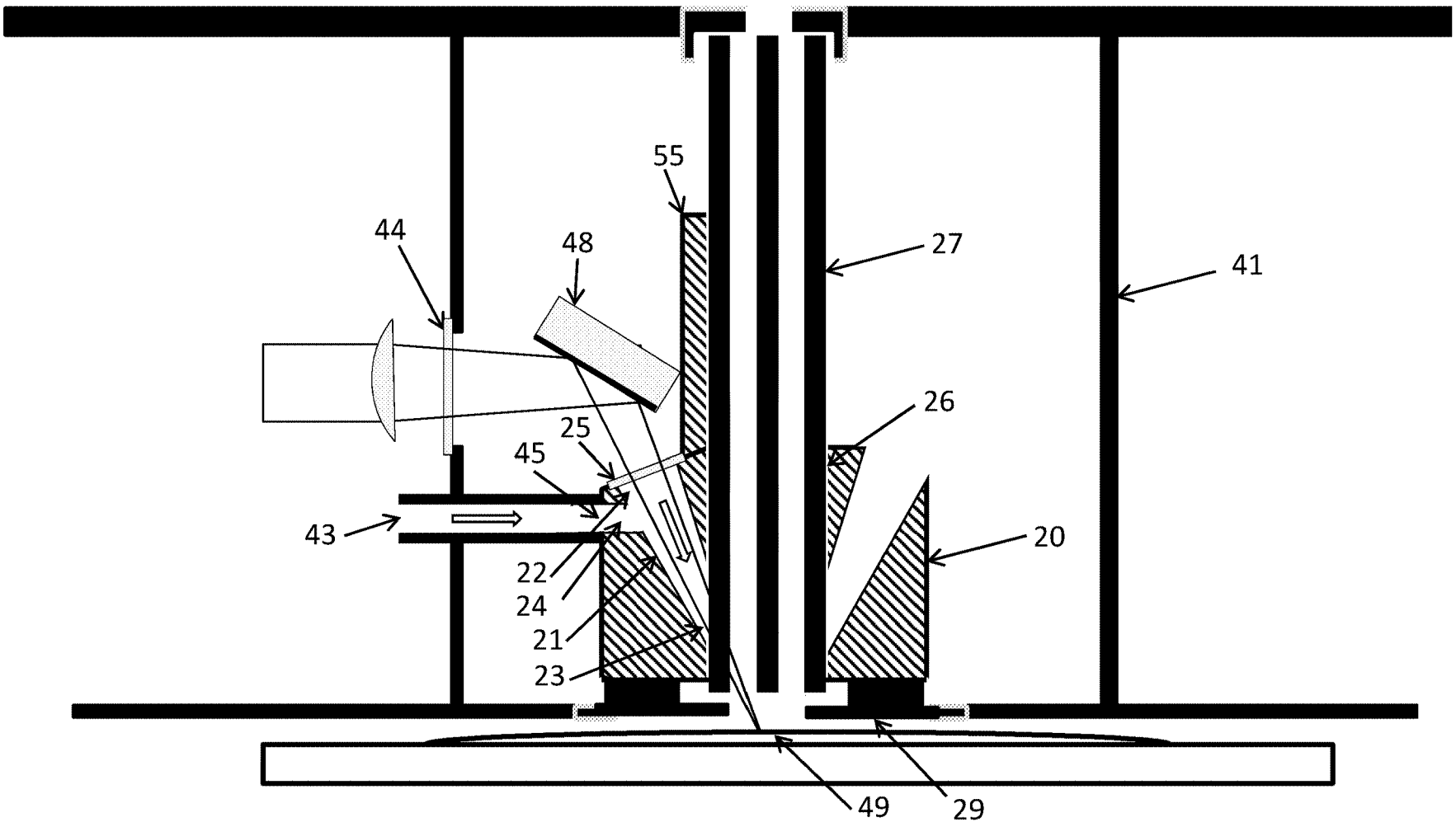
FIG. 6 illustrates an ionisation arrangement according to one embodiment of the present invention, incorporating a nozzle shown in cross-section.

FIG. 6 illustrates an alternative embodiment of a nozzle 20. Like components are given the same reference numerals as FIG. 3. As the ablated material travels through the ion guide 27, some of the material may exit through the sides of the ion guide 27. This material may then adsorb onto surfaces within the ionisation chamber 41, including the beam steering arrangement 48. In FIG. 6, a guard 60 is additionally provided. The guard 60 extends in the direction of the longitudinal axis of an aperture 26 of the nozzle 20. The guard 60 acts as a physical barrier to prevent or reduce the number of particles exiting through the sides of the ion guide 27. The guard 60 shown in FIG. 6 may also be utilised in any of the embodiments discussed herein.

Referring to FIG. 3, in use, a sample is provided on a sample surface 49 adjacent the outlet end 23 of the light passage 21. The laser light source 47 is turned on, causing a laser beam to pass through the window 44 into the ionisation chamber 41. The laser beam from the laser light source 47 is directed through the light passage 21 of the nozzle 20 by the beam steering arrangement 48. The laser beam impinges on the sample, at least partially ionising the sample and creating a plume of material. A flow of gas is provided through the gas passage 24 which subsequently flows into the light passage 23 (as shown by the arrows in FIG. 3). The gas will flow towards the outlet end 23 of the light passage 21, preventing or restricting the amount of ablated material that can enter the light passage 21. At least some of the ionised material will pass through the extraction electrode 29, through the nozzle 20 and into the ion guide 27. The ion guide 27 subsequently directs the ionised material through the ionisation chamber 41 and into a mass spectrometer which is attached to the ionisation chamber 41. The ionised sample can then be analysed by the mass spectrometer.

When used in this specification and claims, numerical ranges are taken to also include the end points of said ranges.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A nozzle for an ionisation source comprising:

a light passage having an inlet end and an outlet end; and a gas flow passage in fluid communication with the light passage, wherein the gas flow passage is configured to convey, in use, a flow of gas into the light passage such that the flow of gas travels substantially towards the outlet end of the light passage.

2. The nozzle of claim 1, wherein the gas flow passage is in fluid communication with the light flow passage between the inlet end of the light passage and the outlet end of the light passage.

3. The nozzle of claim 1, further comprising a window disposed along the light passage.

4. The nozzle of claim 3, wherein the window is disposed adjacent the inlet end of the light passage and/or is received in a recess adjacent the inlet end of the light passage.

5. The nozzle of claim 1, wherein the cross-sectional area of the inlet end of the light passage is larger than the cross-sectional area of the outlet end of the light passage.

6. The nozzle of claim 1, wherein the light passage is substantially conical.

7. The nozzle of claim 1, further comprising an aperture configured to receive an ion guide.

8. The nozzle of claim 7, wherein the angle between the longitudinal axis of the light passage and the longitudinal axis of the aperture is between 0 and 90 degrees, or between 0 and 45 degrees, or between 0 and 30 degrees.

9. The nozzle of claim 7, further comprising a viewing passage, wherein the angle between the longitudinal axis of the viewing passage and the longitudinal axis of the aperture is different to the angle between the longitudinal axis of the light passage and the longitudinal axis of the aperture.

10. The nozzle of claim 7, further comprising a guard which extends in a direction of the longitudinal axis of the aperture.

11. A nozzle assembly comprising:

the nozzle of claim 1;

an ion guide; and an extraction electrode.

12. The nozzle assembly of claim 11, wherein the extraction electrode is disposed adjacent the outlet end of the light passage.

13. The nozzle assembly of claim 11, wherein the extraction electrode comprises a sample inlet configured to receive at least some of an ionised sample in use.

14. An ionisation assembly comprising:

an ionisation chamber; and the nozzle assembly of claim 11 received in the ionisation chamber.

15. The ionisation assembly of claim 14, wherein the nozzle assembly is slidably receivable in the ionisation chamber.

16. The ionisation assembly of claim 14, further comprising a gas supply passage having an inlet end outside of the ionisation chamber to receive a flow of gas, and an outlet end, wherein the gas flow passage of the nozzle has an inlet end which is fluidly connected to the outlet end of the gas supply passage when the nozzle is received in the ionisation chamber.

17. The ionisation assembly of claim 14, further comprising a beam steering arrangement configured to direct a light source through the light passage in use.

18. The ionisation assembly of claim 17, wherein the beam steering arrangement comprises at least one mirror disposed inside the ionisation chamber.

19. A nozzle for an ionisation source comprising:

a light passage having an inlet end and an outlet end; and a window disposed at a location along the light passage.

20. A nozzle for an ionisation source comprising:

a light passage having an inlet end and an outlet end.

* * * * *